United States Patent [19]

Vidal-Meza

[11] 4,346,760

[45] Aug. 31, 1982

[54] HEAT EXCHANGER PLATE HAVING DISTORTION RESISTANT UNIFORM PLEATS

[75] Inventor: Gonzalo D. Vidal-Meza, Peoria, Ill.

[73] Assignee: Caterpillar Tractor Co., Peoria, Ill.

[21] Appl. No.: 277,742

[22] PCT Filed: Feb. 18, 1981

[86] PCT No.: PCT/US81/00208

§ 371 Date: Feb. 18, 1981

§ 102(e) Date: Feb. 18, 1981

[51] Int. Cl.[3] ..... F28F 3/08; F28F 3/04

[52] U.S. Cl. ..... 165/166; 72/385

[58] Field of Search ..... 165/166, 167; 29/157.3 D; 113/118 D, 118 V; 72/379, 383, 384, 385, 389, 390

[56] References Cited

U.S. PATENT DOCUMENTS

| | | | |
|---|---|---|---|
| 3,759,323 | 9/1973 | Dawson et al. | 165/166 |
| 3,892,119 | 7/1975 | Miller et al. | 165/166 |
| 4,022,050 | 5/1977 | Davis et al. | 165/166 |
| 4,031,953 | 6/1977 | Kline | 165/166 |
| 4,183,403 | 1/1980 | Nicholson | 165/166 |

FOREIGN PATENT DOCUMENTS

| | | | |
|---|---|---|---|
| 928590 | 5/1955 | Fed. Rep. of Germany | 165/166 |
| 1476868 | 4/1967 | France | 165/166 |
| 587470 | 4/1957 | Italy | 165/166 |
| 180185 | 7/1962 | Sweden | 165/166 |
| 2543 | of 1897 | United Kingdom | 165/166 |
| 351984 | 6/1931 | United Kingdom | 165/166 |

*Primary Examiner*—Sheldon J. Richter

*Attorney, Agent, or Firm*—Sixbey, Friedman & Leedom

[57] ABSTRACT

A heat exchanger plate (2, 4, 6, 8) having undulatory pleats (12) for forming fluid flow passages (18, 20) on opposite sides of the plate (2, 4, 6, 8) is disclosed. The heat exchanger plate (2, 4, 6, 8) is improved by providing the side walls (38, 42, 44) of each pleat (12) with a uniform slope. By this arrangement, the plate is provided with improved distortion resistance and fluid flow capacity. Method and apparatus for forming the pleated plates are also disclosed for using a pair of non-uniform donative fluid passage forming blades (34″ and 36″) mounted for relative oscillatory movement with respect to a recipient fluid passage forming blade (40″) wherein the clearance between each blade is uniform throughout the entire length of each blade. By making the blade clearance constant the slope of pleat sidewalls may be constant even though each pleat follows a curvilinear path in plan view.

14 Claims, 11 Drawing Figures

HEAT EXCHANGER PLATE HAVING DISTORTION RESISTANT UNIFORM PLEATS

TECHNICAL FIELD

This invention relates to a low cost, distortion resistant heat transfer plate for use in a heat exchanger such as a gas turbine recuperator or other type of primary surface heat exchanger. The invention also relates to a metal working method for efficiently and easily forming a heat transfer plate out of ductile sheet metal and to apparatus for forming an undulatory pattern of uniform pleats in sheet metal designed especially for use as a heat transfer plate in a primary surface heat exchanger.

BACKGROUND ART

Rising energy costs have significantly increased the need for low cost, yet effective, heat exchangers since virtually every type of fuel consuming engine, power plant or industrial process gives off some recoverable heat capable of being converted to useful work. The cost of such exchangers has, however, in the past discouraged wide spread use of heat exchangers in certain applications. One well known type of low cost heat exchanger employs a plurality of stacked plates arranged to allow heat donative and heat recipient fluids to flow in heat exchange relationship on opposite sides of each plate. It has long been recognized that the efficiency of such primary surface heat exchangers is a direct function of the total surface area of the stacked plates and an inverse function of the wall thickness of the plates which separate the heat exchange fluids.

One technique for forming such heat exchanger plates, thus, includes forming a large number of corrugations or pleats in ductile sheet metal of relatively thin gauge. In order to prevent nesting of the plates when stacked, the corrugation pleats are given a wavy (or curvilinear) configuration in plan view. When thus constructed the pleat crests of one plate form at least some points of contact with the crests of the adjacent plates. An example of this type of corrugated heat exchanger plate is illustrated in U.S. Pat. No. 3,759,323, to Dawson et al.

Attempts to increase the heat transfer efficiency of corrugated plates of the type illustrated by U.S. Pat. No. 3,759,323, by metal gauge reduction and increased pleat density, have not always met with success. The structural rigidity of the corrugation pleats is decreased upon reduction in the gauge of metal forming the plate, and when such weakening is combined with an increase in the density of pleats, the chances of a flow passage becoming restricted or obstructed dramatically increases. In particular, weak walled, high density pleats are subject to mechanical distortion during the process of manufacture and are also subject to distortion and/or collapse from uneven temperature induced expansions and contractions.

In U.S. Pat. No. 3,892,119, it is noted that cost savings without reduced efficiency can be realized in the manufacture of heat exchangers formed of plates such as illustrated in U.S. Pat. No. 3,759,323 by increasing the height and number of pleats in each plate to permit reduction in the number of plates required for a given heat exchange capacity. An increase in the height of each pleat, however, has further aggravated the problem of undesired mechanical or temperature induced pleat wall distortions and has, up to the present, placed a practical limit on the efficiency which can be achieved by the use of primary surface heat exchangers employing pleated plates.

DISCLOSURE OF THE INVENTION

The present invention is directed to a low cost, structurally rigid heat transfer plate for use in a heat exchanger wherein the plate is designed to overcome the deficiencies of the prior art as described above. In particular, the heat exchanger plate of the present invention is provided with an undulatory pattern of pleats for forming fluid flow passages on opposite sides of the plate, wherein the side wall of each pleat has a constant slope throughout the length of each fluid flow passage. This uniformity in slope provides greater structural rigidity and over-all uniformity to the heat exchanger plate. Moreover, restriction and/or obstruction of fluid flow passages due to mechanical or temperature induced distortions in the walls forming the fluid flow passages can be reduced by this arrangement without sacrificing the efficiency and low cost manufacturing advantages of prior art pleated heat exchanger plates.

The present invention further provides a method and apparatus for forming a heat exchanger plate having an extremely rigid, uniform characteristic. The method includes the steps of successively bending a sheet of ductile heat conducting material to produce a series of undulatory pleats forming two sets of curvilinear fluid flow passages on opposite sides of the heat exchanger plates wherein the bending steps are controlled in a way to cause the slope of the side walls of each pleat to be constant along the entire length of the corresponding flow passages.

Yet another object of this invention is to provide an apparatus for forming a heat exchanger plate having uniformly sloped pleats including a plurality of cooperating fluid passage forming blades wherein at least one blade has a curvilinear configuration in plan view and a uniform thickness. This blade is positioned for relative reciprocal movement between second and third fluid passage forming blades each having a non-uniform cross-sectional area. The clearance between the first blade and each of the second and third blades is uniform throughout the operative length of the blades to insure a constant slope in the pleats of a plate formed by the apparatus.

A more particular object of the subject invention is to provide a heat exchanger plate including undulatory pleats for forming a set of donative fluid flow passages on one side and a set of recipient fluid flow passages on the other side interleaved with the donative fluid flow passages, wherein the cross-sectional area of each donative fluid flow passage varies in a manner to cause the clearance between the respective fluid passages to be constant.

A more specific object of the subject invention is to provide a heat exchanger plate including undulatory pleats forming recipient fluid flow passages having a uniform cross-section of the type described above wherein each pleat defines a curvilinear periodic function in plan view and is characterized by side walls of constant slope. Each side wall may be subdivided into a plurality of wave length portions which, in plan view, includes a first circular arc surface on one side of the side wall and a second circular arc surface on the opposite side of the side wall. Both the first and second circular arc surfaces have the same center of curvature. A remaining section of each wavelength portion of a side wall includes a third circular arc surface and a fourth circular arc surface in the plan view wherein the third and fourth circular arc surfaces have a coincident center of curvature on the side of the side wall opposite to the center of curvature of the first and second circular arc sections.

Additional objects, advantages and features of the invention will be more readily apparent from the following detailed description of a preferred embodiment of an invention when taken together with the accompanying drawings.

BEST MODE FOR CARRYING OUT THE INVENTION

Figure 1:
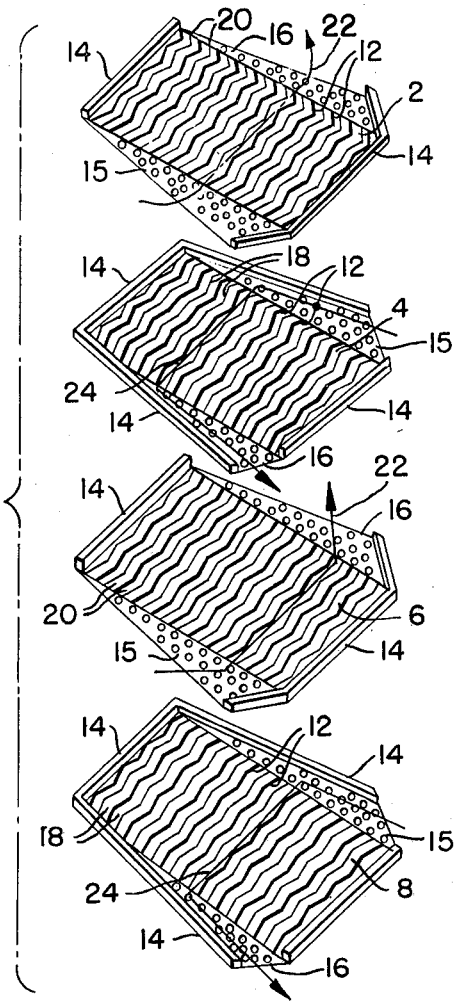
FIG. 1 is an exploded perspective view of a plurality of heat exchanger plates designed in accordance with the subject invention as such plates would be employed in a primary type heat exchanger.

Referring now to FIG. 1, a plurality of heat exchanger plates 2, 4, 6, 8, designed in accordance with the subject invention, are illustrated in exploded perspective view as such plates would be used to form a stacked plate type heat exchanger. Heat exchangers of this general type are disclosed and discussed more fully in U.S. Pat. No. 3,759,323, the disclosure of which is incorporated herein by reference. As explained more fully in the patent, each heat exchanger plate includes a plurality of undulatory pleats 12 having a wavy pattern in plan view designed to prevent nesting of the respective plates by causing the crowns or crests of each pleat to contact the crowns of the pleats formed in an adjacent heat exchanger plate. The side walls of each pleat subdivide the space between adjacent plates into a plurality of fluid flow passages to increase the total surface area actually contacted by the heat transfer fluids flowing between the heat exchanger plates.

As more fully explained in U.S. Pat. No. 3,759,323, edge bars 14 are positioned at selected peripheral positions between successive heat exchanger plates to direct the flow of heat exchange fluids through the heat exchanger and prevent commingling of the fluids while allowing heat transfer therebetween. Inlet sections 15 and outlet sections 16 are attached to opposed sides of each heat exchanger plate to assist in directing the heat exchange fluids into the interplate spaces.

For purposes of this description, the term "donative fluid" will refer to fluids capable of giving up heat energy within a heat exchanger and may include either gas or liquid. The term "recipient fluid" will refer to any fluid, gas or liquid, which, when introduced into a heat exchanger, in capable of receiving heat energy from the donative fluid. In FIG. 1, heat exchanger plates 2 and 4 are designed to define a recipient fluid flow chamber when the respective plates are positioned adjacent one another. Within this recipient fluid flow chamber, a plurality of recipient fluid flow passages 18 are defined by adjacent side walls of the pleats 12 projecting into the recipient fluid flow chamber from plates 2 and 4. Similarly, the space between plates 4 and 6 is designed to form a donative fluid flow chamber with the area between pleats 12 opening into the chamber forming a plurality of donative fluid flow passages 20. In the specific embodiment of FIG. 1 the edge bars 14 and inlet and outlet sections 15 and 16 are arranged to cause the donative fluid to flow along the C-shaped flow path illustrated by arrow 22 within alternate spaced formed by the stacked plates while the recipient fluid is caused to flow in a reverse C-pattern illustrated by arrows 24 within the remaining alternate spaces.

To understand more fully the unique advantages of the subject invention, a previously known pleated heat exchanger plate as disclosed in U.S. Pat. No. 3,892,119 will first be discussed. In this patent, a method and apparatus for forming substantially flat, relatively thin deformable sheet metal into a pleated heat exchanger plate is disclosed. According to the patent, progressive single fold forming steps are performed on the sheet material as it advances between oscillating pleat forming blades mounted on two pairs of opposed forming members. Since the exact purpose and sequential movement of each of the four forming members is not critical to an understanding of the subject invention, reference is made to U.S. Pat. No. 3,892,119 for a more complete description of the movement and purpose of each of the four forming members employed to form a pleated heat exchanger plate of the type to which the subject invention is directed. For purposes of this invention, it is sufficient to note that an upper donative fluid flow passage forming blade is mounted for relative oscillatory movement with respect to a lower recipent fluid flow passage forming blade. The blades are designed to move between a first position in which the blades are separated to receive an unpleated ductile sheet material and a second position in which the ductile sheet material has been deformed so as to form a pleat side wall in the clearance space between the respective passage forming blades.

Figure 2:
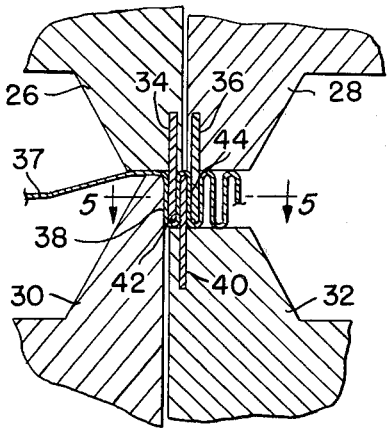
FIG. 2 is a cross-sectional view of an apparatus designed in accordance with the subject invention for forming a heat exchanger plate having distortion resistant uniform undulatory pleats.

FIG. 2 is a schematic cross-sectional illustration of pleating apparatus in which both the method and apparatus of the prior art as well as that of the present invention may be employed. In particular, two pairs of relatively movable forming means 26, 28, 30 and 32 are illustrated. First forming means 26 and second forming means 28 each carry an identical donative fluid passage forming blade 34 and 36, respectively. Third forming means 30 is positioned to cooperate with blade 34 in order to properly position the incoming ductile sheet material 37 and to form one side wall 38 of each pleat. Fourth forming means 32 supports a recipient fluid passage forming blade 40 adapted to enter the space between blades 34 and 36 as illustrated in FIG. 2, thereby causing a second side wall 42 to be formed in the clearance space between blades 34 and 40 and a third side wall 44 to be formed in the clearance space between blades 40 and 36.

Figure 3:
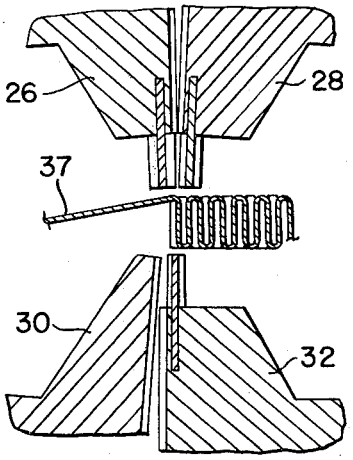
FIG. 3 is a cross-sectional view of the apparatus illustrated in FIG. 2 wherein portions of the apparatus have been moved to an open position in preparation for a pleat forming operation.

FIG. 3 illustrates the apparatus of FIG. 2 wherein first and second forming means 26 and 28 have been displaced upwardly to permit the ductile sheet material 37 to be displaced by a distance equal to the wavelength of the pleat wave in plan view in preparation for forming a successive pleat by forming means 26 through 32 all as described in greater detail in U.S. Pat. No. 3,892,119.

Figure 4:
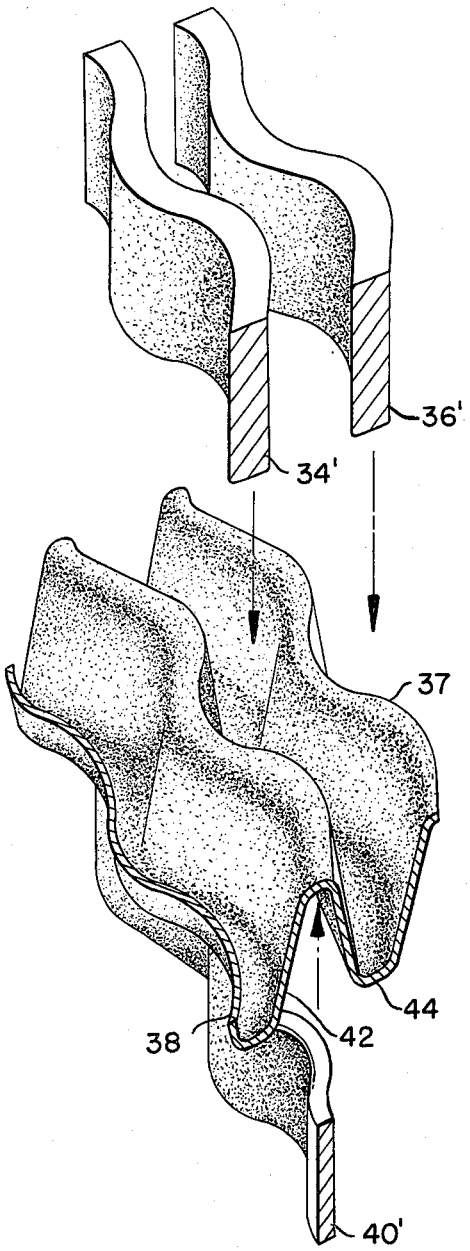
FIG. 4. (PRIOR ART)
FIG. 4 is a cut-away perspective view of a prior art pleating apparatus.
Figure 5:
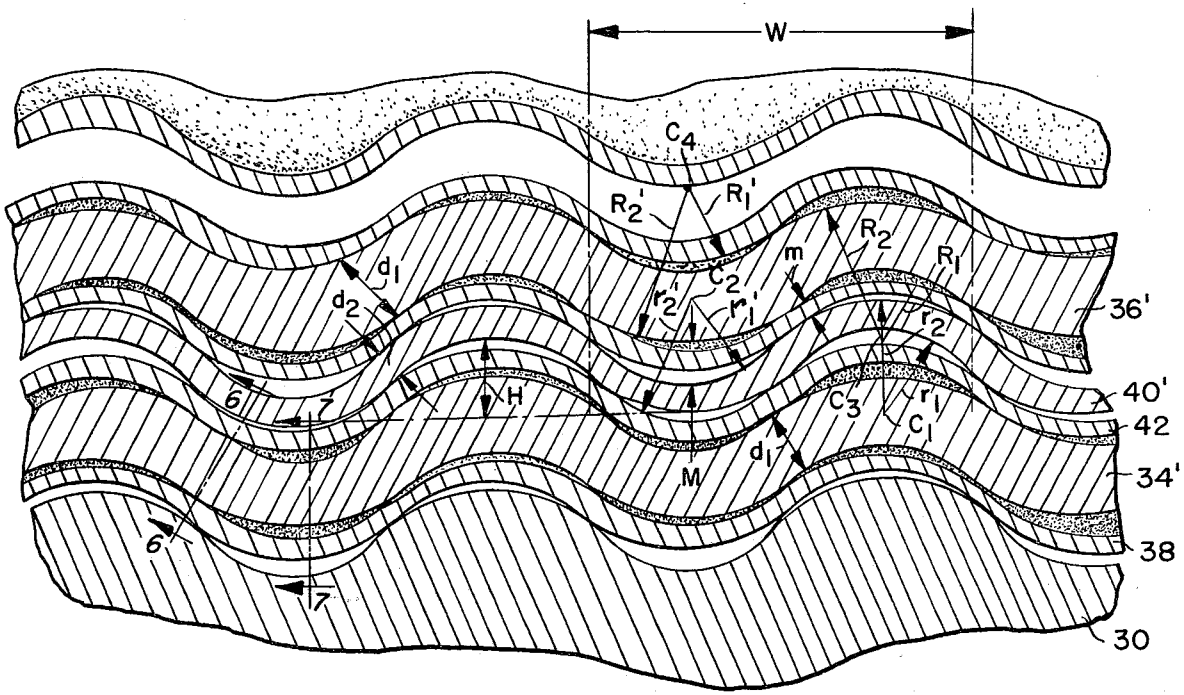
FIG. 5. (PRIOR ART)
FIG. 5 is a cross-sectional view of the prior art pleating apparatus illustrated in FIG. 4 as such apparatus would appear when moved to the position illustrated in FIG. 2, the cross-sectional view being taken along lines 5—5 of FIG. 2.

Turning now to FIG. 4, a perspective view of prior art fluid passage forming blades of the type used in the apparatus of U.S. Pat. No. 3,892,119 is shown including a pair of donative fluid flow passage forming blades 34' and 36' and a recipient fluid flow passage forming blades 40'. The prior art blades of FIG. 4 have uniform thicknesses. When equipped with fluid passage forming blades of this type, the apparatus of FIG. 2 will form pleats in ductile sheet material 37 having side walls of irregular slope, thus creating an unstable structure in which the side walls are easily distorted by outside mechanical force or temperature induced contractions and expansions. To understand this more fully, reference is made to FIG. 5 wherein a cross-sectional view taken along lines 5—5 of the apparatus of FIG. 2 is illustrated as the apparatus would appear if equipped with the prior art blades of FIG. 4. In particular, FIG. 5 illustrates donative fluid passage forming blades 34' and 36' having a constant thickness $d_1$ and a pair of curvilinear side walls each of which consists of alternating circuar arcs arranged in a path which defines a periodic function. The recipient fluid passage forming blade 40' is also formed with a constant thickness $d_2$ and is provided with side walls which in cross section are each formed of successive circular arcs which define a periodic function having the same phase and wavelength as the periodic functions defined by the surfaces of blades 34' and 36'. As long as the passage forming blades have a constant thickness, the clearance space between the blades in plan view, regardless of the shape or configuration of the curvilinear pattern formed by the blade surfaces, cannot be constant. Even if the surfaces of each blade were formed by identical sine waves displaced laterally, the clearance spacing between the blade surfaces would still vary when the clearance is measured in a direction perpendicular to the central axis of the clearance space. For purposes of this application, the central axis between two curvilinear lines will be defined as the loci of all points located midway between the two curvilinear lines as measured along a line normal to one of the curvilinear lines at each point along such line. Obviously, this definition presupposes the absence of any discontinuities in the two curvilinear lines in order for there to be a continuous central axis.

When the height of the pleats is constant and the clearance between blade surfaces is variable, it is obvious that the slope of the side walls of the pleats must be variable as measured in a plane perpendicular to the central axis of the clearance in plan view. Such variation in side wall slope greatly affects the lateral stiffness of the pleats and causes them to close up in some areas, thus restricting the total flow area of a heat exchanger formed with pleated heat exchanger plates. To understand this more clearly, it should be noted that the total effective cross-sectional area for the flow of gaseous donative fluid is normally made larger than the effective cross-sectional area of the flow of recipient fluid since the higher temperature donative fluid will normally be available in larger volume in the heat exchange process. Thus, given the requirement that the number of donative fluid passages and recipient fluid passages must be equal, it follows that each donative fluid flow passage must be larger in cross-sectional area than is each of the recipient fluid flow passages. As illustrated in FIG. 5, each wavelength portion W of blade 40' is constructed in a first section with side walls which sweep out circular arcs having radii $r_1$ and $r_2$ with both arcs having a coincident center of curvature $C_1$. The remaining portion of the wavelength section of blade 40' is similarly formed to provide blade surfaces having radii of curvature $r_1'$ and $r_2'$ with a coincident center of curvature $C_2$ located on the opposite side of the blade. If the blade is made symmetrically so that $r_1=r_1'$ and $r_2=r_2'$, each wavelength portion of donative fluid forming passage blades 34' and 36' similarly includes surfaces which define circular arcs having radii of curvature $R_1$ and $R_2$ with a coincident center of curvature $C_3$. A second section of each wavelength portion of blades 34' and 36' has corresponding radii of curvature $R_1'$, and $R_2'$ with a coincident center of curvature $C_4$ located on an opposite side of blades 34' and 36' from center of curvature $C_3$. Since these blades are normally made to be symmetrical, $R_1=R_1'$ and $R_2=R_2'$.

Since the wave patterns defined by the blades are symmetrical, the centers of curvature of the blade surfaces are also symmetrical and are displaced by an amount equal to the double amplitude H of each wave plus $r_2-r_1$. This relationship facilitates the construction and reproduction of the heat exchanger plate. As can be understood by reference to FIG. 5, the clearance between the blades varies from a maximum of M to a minimum of m. The minimum clearance m is normally made only slightly larger than the thickness of the plate material plus a small amount allowed for ease of withdrawing the blades of the pleating apparatus. This arrangement allows the greatest number of pleats per unit length of plate as possible.

When spaced in this manner, the slope of the side walls formed in the areas of minimum clearance m between the respective passage forming blades will have a substantially vertical slope. Side walls formed in this manner have very little lateral rigidity which causes shifting of the pleating and uncontrolled obstruction of the fluid flow passages. Some shifting of the side walls forming the donative fluid flow passages may be tolerated since these passages have a substantial larger cross-sectional area. However, a shift in the side walls forming each of the recipient fluid flow passages can be highly detrimental due to their smaller cross-sectional area.

Figure 6:
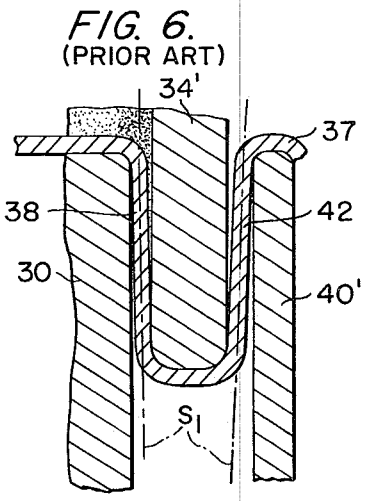
FIG. 6. (PRIOR ART)
FIG. 6 is a partial cross-sectional view of the pleat forming apparatus of FIG. 5 as taken along lines 6—6.

The disadvantages of varying side wall slope are illustrated more graphically in FIG. 6 which is a partial cross-sectional view taken along lines 6—6 of FIG. 5 located at a point of minimum clearance between respective pleat forming blades. In particular, lines 6—6 indicate a cross-section taken along a plane perpendicular to the central axis of blade 34' and thus lines $s_1$ in FIG. 6 are representative of the slope of both side walls 38 and 42. As is apparent, the slope of these side walls is virtually perpendicular to the plan surface of the heat exchanger plate being pleated.

Figure 7:
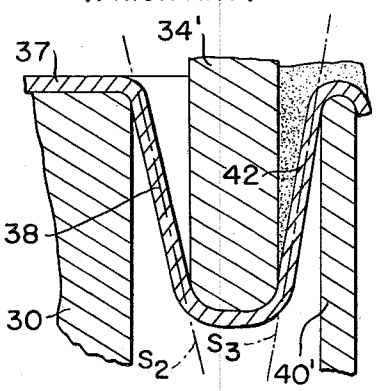
FIG. 7. (PRIOR ART)
FIG. 7 is a partial cross-sectional view of the pleat forming apparatus of FIG. 5 taken along lines 7—7.

Contrasting with the configuration of FIG. 6 is the cross-sectional view of FIG. 7 of a portion of a heat exchanger plate being formed by the assembly illustrated in FIG. 5 as taken along line 7—7. In particular, note the slope of side wall 38 as represented by line $s_2$ and yet another slope angle represented by line $s_3$ of side wall 42. As can now be readily appreciated this varying slope of the pleat side walls 38 and 42 along the longitudinal extent of each pleat formed by the assembly of FIG. 5 results from variation in the clearance between the blade surfaces.

Figure 8:
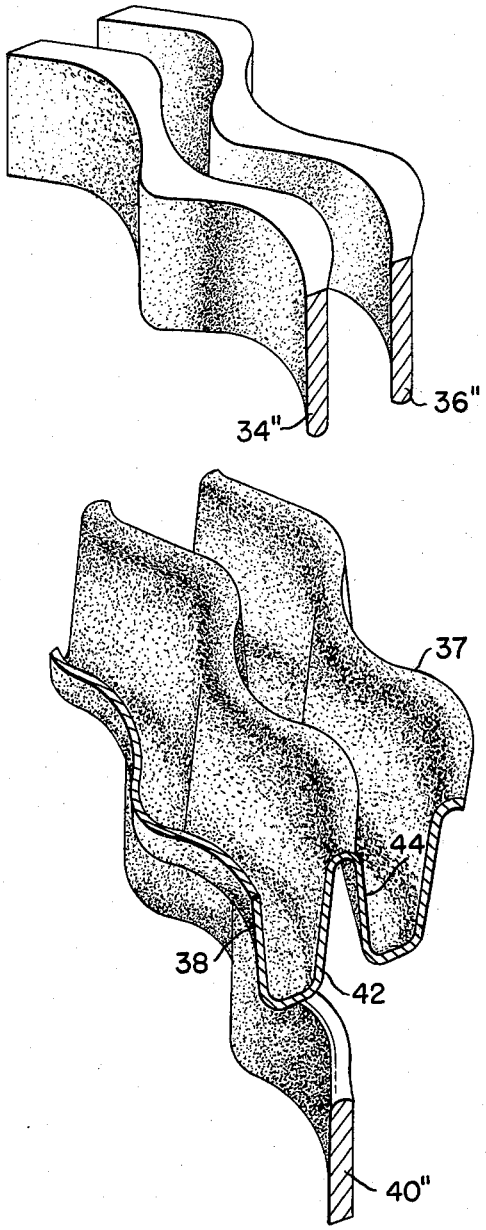
FIG. 8 is an exploded, cutaway, perspective view of a pleat forming apparatus designed in accordance with the subject invention.

Reference is now made to FIG. 8, wherein a perspective view is shown of the heat exchanger plate forming apparatus of the subject invention. As clearly illustrated in FIG. 8, donative fluid flow passage forming blades 34'' and 36'' have been substituted for the corresponding blades of the prior art illustrated in FIG. 4. As is apparent by a comparison of FIGS. 4 and 8, blades 34'' and 36'' have a non-uniform cross-sectional configuration. To understand the precise function of the modified blades 34'' and 36'', reference is made to FIG. 9, which is a cross-sectional view of the apparatus illustrated in FIG. 8 when positioned by the forming assembly, illustrated in FIG. 2 taken along lines 5—5.

Figure 9:
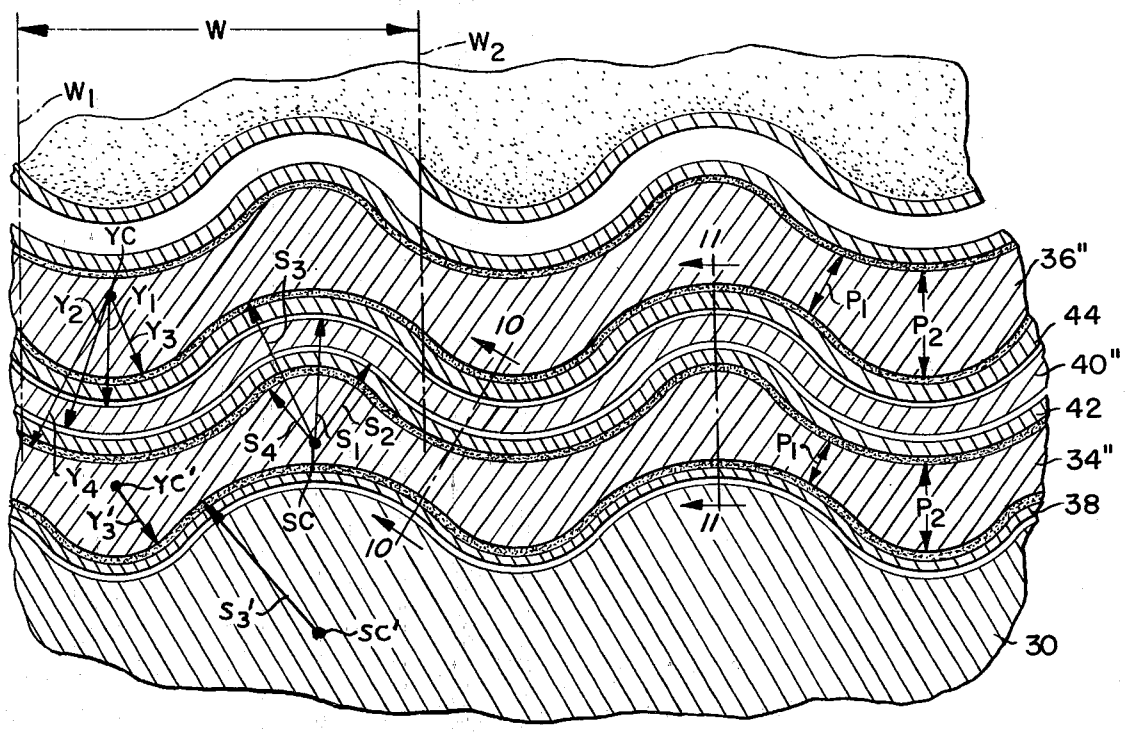
FIG. 9 is a cross-sectional view of the pleat forming apparatus illustrated in FIG. 8 as such would appear when moved to the position illustrated in FIG. 2, the cross-sectional view being taken along lines 5—5.

Referring now particularly to FIG. 9, the donative fluid passage forming blades 34'' and 36'' are shown as having a substantial blade thickness variation along the longitudinal extent of each blade from a minimum of $P_1$ to a maximum of $P_2$. In contrast to this, the recipient fluid passage forming blade 40'' is provided with a uniform thickness as measured in the direction of a plane passing perpendicularly through the central axis of the blade in plan view along the entire longitudinal length of the central axis. Variations in the width of the donative fluid flow passages are significantly more acceptable in view of the substantial width of such passages as compared with the narrower cross-sectional width of the recipient fluid flow passages. Any variation in the cross-sectional width of such recipient fluid flow passages could obviously be more detrimental to the efficient operation of a heat exchanger formed from pleated plates than would variations in the cross-sectional area of a donative flow passage. More significantly, however, is the fact that a uniform clearance space between the surfaces of blade 40'' and each of the blades 34'' and 36'' results in the formation of pleat side walls having a constant uniform slope as measured in a plane passing perpendicularly through the central axis of each flow passage.

Achieving both uniform cross section in each recipient flow passage and uniform slope in the orientation of the side walls of all pleats having a curvilinear plan view configuration requires very careful design of the respective blades 34'', 36'' and 40''. Reference is now made to a wavelength W section of each of the blades 34'', 36'' and 40'' wherein the general case required for forming a recipient flow passage of uniform cross-sectional area combined with pleat side walls having a constant slope throughout the heat exchanger plate is illustrated. In particular, the wavelength portion W of blades 34'', 36'' and 40'' spanning between the lines marked $w_1$ and $w_2$ can each be divided into a first arcuate section wherein the radii of curvature of the respective side walls of blade 40'' are indicated by $S_1$ and $S_2$, respectively. The adjacent surfaces of blades 34'' and 36'' facing the corresponding surfaces of blades 40'' are shown by arrows indicated at $S_3$ and $S_4$, respectively.

As illustrated in FIG. 9, the center of curvature of each of the circular arcs identified by arrows $S_1$ through $S_4$ are coincident at point SC. Similarly, the remaining side surfaces of each of the blades 34'', 36'' and 40'' form in plan view circular arcs touched by arrows $Y_1$, $Y_2$, $Y_3$ and $Y_4$ having a coincident center of curvature YC located on a side of blade 40'' opposite to center of curvature SC. The circular arcs touched by arrows $Y_1$ and $S_1$ complete a full wavelength of one side of blade 40''. Similarly, arrows $Y_2$ and $S_2$ complete a wavelength of the opposite side of blade 40''. A full wavelength of the surface of blade 34'' adjacent blade 40'' is formed by circular arcs touched by arrows $Y_4$ and $S_4$. Finally, a full wave length of the side of blade 36'' adjacent blade 40'' is formed by the circular arcs touched by arrows $Y_3$ and $S_3$. By this arrangement, the clearance space between blades 34'', 36'' and 40'' is uniform. It is not, however, necessary for the first and second circular arcs of each blade surface to have equal radii since the waves need not be symmetrical when viewed from opposite sides of the heat exchanger plate. Moreover, the wavelength W along the longitudinal extent of each blade need not be identical nor is it necessary for the amplitude of successive wavelength portions W of each of the blades to be equal. By merely maintaining coincidence of the center of curvature of each of the circular arcs touched by arrows identified by $S_1$–$S_4$ and similarly maintaining the coincidence of the center of curvature of each of the circular arcs touched by the arrows $Y_1$–$Y_4$, the cross-sectional area of the recipient fluid flow passages formed by blade 40'' will remain constant throughout their longitudinal length. At the same time the slope of all of the side walls forming the pleats within the heat exchanger plate will remain uniformly constant and equal throughout the full longitudinal extent of each pleat. The side walls 42 and 44 similarly include wavelength sections W having concentric circular arc sections having radii of curvature corresponding to the radii $S_1$ through $S_4$ and $Y_1$ through $Y_4$. Each such radius is less or greater than the corresponding radius by an amount equal to the spacing of the blade surface from the corresponding side wall surface.

Figure 10:
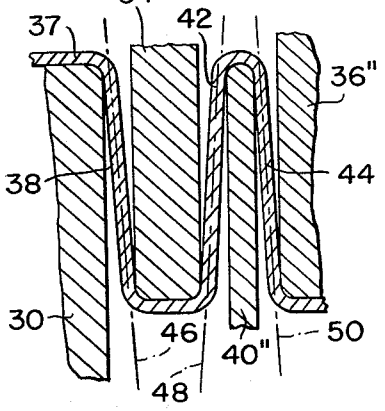
FIG. 10 is a partial cross-sectional view of the pleat forming apparatus of FIG. 9 as taken along lines 10—10.

Turning now to FIG. 10, a partial cross-sectional view of blades 34'', 36'' and 40'' is illustrated as taken along lines 10—10 of FIG. 9 wherein the slopes of side walls 38, 42 and 44 are illustrated by lines 46, 48 and 50. As can be seen in FIG. 10, lines 46, 48 and 50 form an equal angle relative to a plane formed by the outer plan surfaces of the pleated heat exchanger plate.

Figure 11:
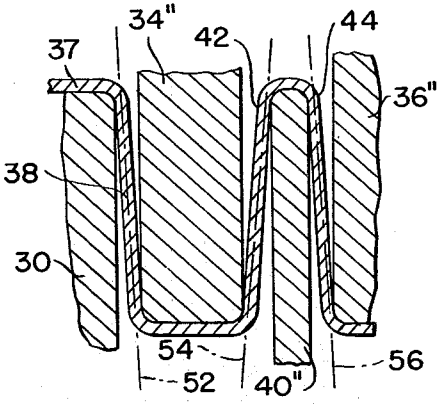
FIG. 11 is a partial cross-sectional view of the apparatus of FIG. 9 as taken along lines 11—11.

FIG. 11 similarly discloses a partial cross-sectional view of blades 34'', 36'' and 40'' taken along lines 11—11 of FIG. 9. Note that the cross-sectional view of FIG. 11 has been taken at a point of maximum width of blade 34'' as compared with the position of the cross-sectional view illustrated in FIG. 10 wherein the thickness of blade 34'' is at a minimum. Despite this variation in the cross section width of blade 34'', the slopes of side walls 38, 42 and 44 as represented by lines 52, 54 and 56 are identical to the slopes of the corresponding lines 46, 48 and 50 of FIG. 9.

It should now be amply apparent that the method and apparatus of forming a pleated heat exchanger plate is illustrated in FIGS. 8–11, is capable of providing a heat exchanger plate wherein the recipient fluid flow passages include uniform and constant cross-sectional areas while the slope of the side walls of the pleats forming the respective fluid flow passages is constant throughout the entire longitudinal extent of each fluid flow passage. By this arrangement, a highly efficient, compact and rigid heat exchanger can be formed by stacking plural pleated heat exchanger plates of the type formed by the apparatus and method illustrated in FIGS. 2, 8 and 9.

INDUSTRIAL APPLICABILITY

Heat exchangers formed by the method and apparatus disclosed herein, as well as the heat exchanger plates designed in accordance with this invention, can be employed in a vast number of applications wherein the transfer of heat from one fluid to a second fluid is desired. For example, the exhaust gases from a gas turbine may form the donative fluid for heating the compressed intake air leading to the combustor and then to the turbine whereby the intake air becomes the recipient fluid referred to above. Alternatively, a heat exchanger formed in accordance with the subject invention and including the pleated plates described above can be used in the boiler of a steam generation device wherein hot gases from fuel combustion forms the donative fluid while the recipient fluid is the return water or make-up water from which steam is to be generated in the heat exchanger. Still other applications include the use of a heat exchanger formed in accordance with the subject invention wherein the recipient fluid is the cooling water of an internal combustion engine and the donative fluid is the hot oil. Additional applications include the use of heat exchangers of the subject type employed in heat treatment furnaces and other industrial applications wherein it is desired to transfer heat from one fluid to another.

Other aspects, objects and advantages of this invention can be obtained from a study of the drawings, the disclosure and the appended claims.

I claim:

1. A heat exchanger plate (2,4,6,8) for forming a barrier between donative recipient fluids flowing through the heat exchanger and for forming fluid flow passages (18,20) arranged to cause heat transfer through the plate from the donative fluid to the recipient fluid, said plate (2,4,6,8) including undulatory pleates (12) forming a set of donative fluid flow passages (20) on one side of said plates and a set of recipient fluid flow passages (18) on the other side of said plates interleaved with the donative fluid flow passages (20), each flow passage (18, 20) being bounded on opposite sides in plan view by the side walls (38, 42, 44) of a pleat (12) and having a central axis in plan view extending along a continuous curvilinear path between separate points on the plate perimeter, characterized in that the slope of each said side wall (38, 42, 44) of each said pleat (12) is constant along the entire length of the flow passage (18, 20), wherein the slope is measured in a plane perpendicular to the central axis of the corresponding flow passage (18, 20).

2. A heat exchanger plate (2, 4, 6, 8) as defined in claim 1, wherein said donative and recipient fluids are gases.

3. A heat exchange plate as defined in claim 1, wherein one of said fluids is a gas and the other said fluid is a liquid.

4. A heat exchange plate (2, 4, 6, 8) as defined in claim 1, wherein the slope of each said side wall (38, 42, 44) is equal to the slope of all other said side walls (38, 42, 44).

5. A heat exchanger plate (2, 4, 6, 8) as defined in claim 4, wherein all flow passages (18, 20) within one of said sets of flow passages (18, 20) have a constant cross-sectional area along their entire lengths as measured in a plane perpendicular to the central axis of each flow passage (18, 20).

6. A heat exchanger plate (2, 4, 6, 8) as defined in claim 5, wherein the cross-sectional area of each flow passage (18, 20) is equal to the cross-sectional area of all other flow passages (18, 20) within said one set.

7. A heat exchanger plate (2, 4, 6, 8) as defined in claim 6, wherein the cross-sectional area of each flow passage (18, 20) within the other set of flow passages (18, 20) is variable along its length.

8. A heat exchanger plate (2, 4, 6, 8) as defined in claim 7, wherein said flow passages (18, 20) within said one set have a cross-sectional area less than the cross-sectional area of the flow passages (18, 20) in said other set.

9. A heat exchanger plate (2, 4, 6, 8) as defined in claim 8, wherein said one set of flow passages (18) includes said recipient fluid flow passages.

10. A heat exchanger plate (2, 4, 6, 8) as defined in claim 9, wherein said central axis defines a curvilinear path having a periodic function.

11. A heat exchanger plate (2, 4, 6, 8) as defined in claim 10, wherein the wavelength of said periodic function is constant.

12. A heat exchanger plate (2, 4, 6, 8) as defined in claim 11, wherein the amplitude of said periodic function of each central axis of said flow passages in said one set is constant.

13. A heat exchange plate (2, 4, 6, 8) as defined in claim 12, wherein the undulatory walls (42, 44) of each of the recipient fluid flow passages (18) may be divided into a plurality of wavelength portions (W), each wavelength portion including a first section which in plan view forms a first circular arc ($Y_1$) on the recipient fluid passage side and a second circular arc ($Y_2$) on the recipient fluid passage side with the first and second circular arcs having a first coincident center of curvature (YC) on one side of the walls (42, 44) and wherein each wavelength portion (W) on the adjacent sides of walls (42, 44) includes a remaining section which in plan view forms a third circular arc ($S_2$) on the recipient fluid passage side and a fourth circular arc ($S_1$) on the recipient fluid passage side with the third and fourth circular arcs having a second coincident center of curvature (SC) on the side of said side wall which is opposite said first coincident center of curvature.

14. A heat exchange plate (2, 4, 6, 8) as defined in claim 12, wherein the undulatory walls (38, 42) of each of the donative fluid flow passages (20) may be divided into a plurality of wavelength portions (W), each wavelength portion including a first section which in plan view forms a first circular arc ($Y_4$) on the donative fluid passage side and a second circular arc ($Y_3'$) on the donative fluid passage side with the first and second circular arcs having first and second centers of curvature (YC, YC') being displaced a distance equal to the distance between pleats on one side of the side wall (38) and wherein each wavelength portion (W) on the adjacent sides of walls (38, 42) includes a remaining section which in plan view forms a third circular arc ($S_4$) on the donative fluid passage side and a fourth circular arc ($S_3'$) on the donative fluid passage side with the third and fourth circular arcs having third and fourth centers of curvature (SC, SC') being displaced a distance equal to the distance between pleats on the side of wall (42) which are opposite said first and second centers of curvature.

* * * * *